United States Patent [19]

Slobodkin

[11] Patent Number: 4,881,935

[45] Date of Patent: Nov. 21, 1989

[54] METHOD FOR CONSTANT PRESSURE DIAGONAL-WEB CRUSH-SCORING

[75] Inventor: Yefim Slobodkin, Lyndhurst, Ohio

[73] Assignee: Avery International Corporation, Pasadena, Calif.

[21] Appl. No.: 233,945

[22] Filed: Aug. 18, 1988

Related U.S. Application Data

[63] Continuation of Ser. No. 096,904, Sep. 14, 1987, abandoned, which is a continuation of Ser. No. 804,817, Dec. 4, 1985, Pat. No. 4,698,052.

[51] Int. Cl.[4] ..... B05B 1/14

[52] U.S. Cl. ..... 493/355; 493/403; 83/347

[58] Field of Search ..... 493/58, 59, 61, 66, 493/355, 361, 363, 365, 367–371, 463, 401, 402; 29/121.4; 83/422, 506, 881, 883, 346, 347, 884, 886, 887

[56] References Cited

U.S. PATENT DOCUMENTS

| | | | |
|---|---|---|---|
| 1,704,186 | 3/1929 | Gammeter . | |
| 2,292,723 | 8/1942 | Stocker | 83/506 |
| 3,147,656 | 9/1964 | Kwitek . | |
| 3,348,477 | 10/1967 | Taylor, Jr. et al. | 83/347 |
| 3,570,337 | 3/1971 | Morgan | 493/402 |
| 3,826,165 | 7/1974 | Currie et al. | 83/678 |
| 3,900,645 | 8/1975 | Morgan | 156/247 |
| 4,220,490 | 9/1980 | Carlson | 156/257 |
| 4,257,298 | 3/1981 | Agkut | 83/482 |
| 4,698,052 | 10/1987 | Slobodkin | 493/355 |

*Primary Examiner*—Frederick R. Schmidt
*Assistant Examiner*—Robert Showalter
*Attorney, Agent, or Firm*—Christie, Parker & Hale

[57] ABSTRACT

There is provided an apparatus for applying constant pressure to a plurality of anvil rollers for crush-scoring used in combination with crush-scoring cylinders having protrusions extending from the surface thereof. Each anvil roller is supported in a substantially frictionless manner and the constant pressure is supplied by a flexible diaphragm acting on a plunger which can move substantially without friction in a pneumatic cylinder.

6 Claims, 5 Drawing Sheets

134
130
122
124
118
116
112
114
104
120
32
34
106
105
10
100
103
108
110
102
128
126
18

METHOD FOR CONSTANT PRESSURE DIAGONAL-WEB CRUSH-SCORING

CROSS-REFERENCE TO RELATED APPLICATIONS

This is a continuation division of application Ser. No. 096,904 filed 9/14/87, now abandoned, which was a continuation of 804,817 filed Dec. 4, 1985, now U.S. Pat. No. 4,698,052.

FIELD OF THE INVENTION

The present invention is directed to an apparatus for applying constant pressure in mechanical diagonal-web crush-scoring and, more particularly, to an apparatus for diagonal crush-scoring a web to be used as the release liner or backing for labels, stickers, tapes, or similar articles bearing a pressure-sensitive adhesive.

BACKGROUND OF THE INVENTION

Adhesive products such as labels, stickers, tapes, and similar articles, are normally comprised of a surface sheet or facestock, a layer of adhesive, normally pressure-sensitive, secured to the back face of such surface sheet, and a removable paper backing sheet or release liner secured to the adhesive layer by a low surface-energy bond, such as a silicon coating, for ultimate removal when the label, sticker, or the like, is to be affixed to an article or substrate for end-use purpose. The backing sheet can be difficult to remove because no edge is usually exposed to facilitate grasping the backing sheet for its removal.

One approach to overcoming the difficulties encountered in removing backing sheets, is to crush-score the backing sheet before it is secured to the layer of adhesive and before it is silicone-release-coated. Crushscoring leaves a line in the backing sheet that has been weakened by a compaction of the fibres in the sheet. When a label, sticker or the like is to be affixed, it can be flexed to cause the backing sheet to split or tear along the score line, creating a pair of exposed edges for grasping the backing sheet. The final dimensions of the labels, stickers or the like to be produced, often makes it advantageous to arrange the score lines in a diagonal pattern on the backing sheet, to maximize the length of score line available on the back of the product for creating exposed edges.

The amount of weakening that takes place during crush-scoring, however, must be carefully controlled to prevent splitting or tearing of the backing sheet while it is being processed or prepared for use, and to avoid producing labels, stickers or the like where splitting or tearing prematurely occurs or does not occur upon flexing.

Forming diagonal scores across a web of paper for release-liner use has been determined, with proper spacing of scores, to enable lables of any size to be cut from the web, with high statistical assurance that it will contain at least one edge-to-edge score to insure a crack-and-peel feature, i.e., the ability to form a crack at any score line and peel the backing across any other score line present.

The present invention is directed to a system for uniform diagonal crush-scoring at a constant and controllable pressure, to achieve a product of the highest quality.

SUMMARY OF THE INVENTION

According to the present invention, there is provided apparatus for crush-scoring paper, particularly paper used as the release liner in label construction, in which a floating force for scoring is maintained substantially constant and unbiased, and is applied to the surface undergoing crush-scoring, under essentially friction-free conditions.

The heart of the system is a support providing a pair of guide rods, preferably cylindrical rods set in substantially frictionless bearings, which extend outwardly from the support means and are coupled to a mounting bracket which contains, for present purposes, a cylindrical anvil roller, used to crush-score paper.

Between the circular guides, is a plunger which extends from the mounting bracket to a sealed flexible diaphragm, which is in communication with a pressurized fluid, preferably gaseous, and which provides the force to be transmitted through the rod to the mounting bracket.

In the preferred assembly, the plunger is not secured to the mounting bracket nor the diaphragm, and the cooperation among the mounting bracket, the plunger, and the diaphragm, does not involve the use of frictional measures and is bond-free. This, coupled with the use of essentially frictionless mounts and guides, insures that the mounting bracket will float, and that the force applied to the mounting bracket, and therefore to the anvil rollers, will be essentially unidirectional and controlled by the amount of fluid pressure applied to the diaphragm.

In the system for crush-scoring paper, a plurality of anvil rollers contained on a corresponding plurality of mounting brackets on a plurality of adjacent supports, are positioned in staggered, overlapping relation along a support rod. Each is readily removable as wear or damage dictates. Preferably, the cylindrical anvil rollers are pivotably adjustable to insure positioning parallel to the crushing cylinder. Paper is passed between the anvil rollers and a wire-wound crushing cylinder. The wires are removably embedded in grooves extending diagonally across the surface of the cylinder from edge to edge. Preferably, they are spring-tensioned to account for thermal expansion and contraction. They are precision-ground to insure uniform extension from the surface of the cylinder.

In the process of scoring, paper from a roll is passed between the crushing cylinder and a plurality of anvil rollers, with pressure applied against each being tailored to achieve the depth of score desired for appropriate cracking and peel performance of the paper. Backlighting enables inspection of fluctuations in depth of the score, and adjustment of the applied pressure accordingly.

By use of the apparatus of the instant invention, higher-quality scores than ever previously achieved, may be realized for uniform performance of the products in the hands of the consumer.

BRIEF DESCRIPTION OF THE DRAWINGS

These and other features and advantages of the present invention, will be better understood by reference to the following detailed description, when considered in conjunction with the accompanying drawings, wherein.

DETAILED DESCRIPTION

Figure 1:
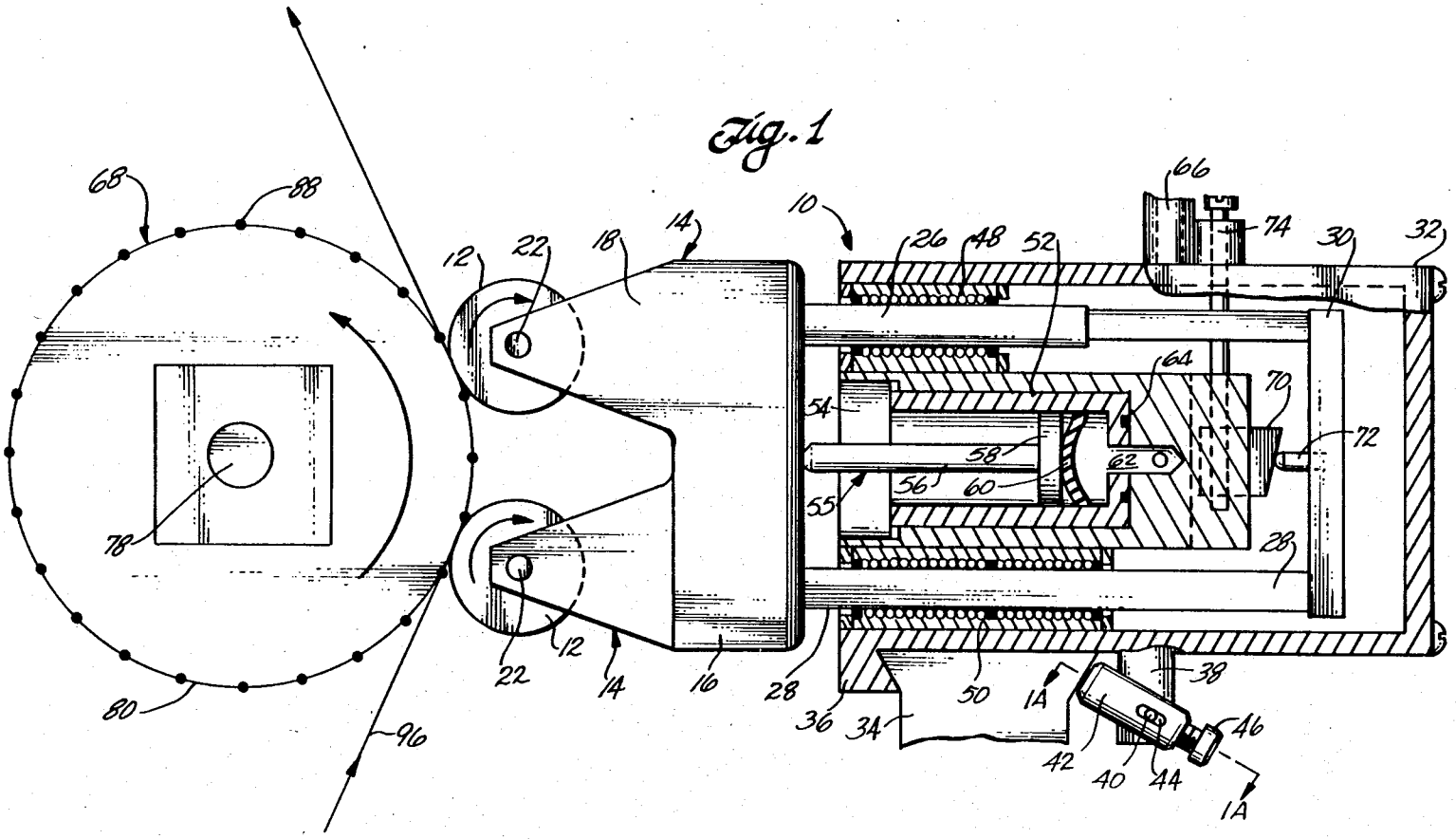
FIG. 1 shows a schematic, sectional side view of an apparatus for applying to an anvil roller constant pressure in crush-scoring according to the present invention.

The present invention pertains to an apparatus for crush-scoring paper, in which a plurality of cylindrical anvil rollers are independently supportedd in a substantially frictionless manner, for selectively applying an unbiased constant pressure to diagonal wires of a wire-wound cylinder, to enable diagonal crushing of paper at uniform loads across the cylinder. The following is a description of a preferred embodiment of the invention as shown in the drawings.

With reference to FIGS. 1, 1A, 2, 2A, and 2B, each anvil roller holder 10 has cylindrical anvil roller 12 rotatably supported by mounting bracket 14. Mounting bracket 14 is of unitary construction, preferably one piece comprised of end member 16, from which a pair of panel members 18 and 20 extend outwardly, parallel to one another. A cylindrical pin 22 extends between side panels 18 and 20 at a point remote from the back spacer bar 16. Pin 22 extends through a corresponding hole in the center of anvil roller 12. The anvil roller freely rotates about pin 22, preferably by means of ball or roller bearings.

Anvil roller 12 should be as perfectly cylindrical as possible.

Extending outward from the surface of end member 16, opposite anvil roller 12, is a pair of smooth guide rods 26 and 28, which are preferably cylindrical, as shown. The guides extend, parallel to one another, outward from opposite ends of spacer bar 16. The opposed or remote ends of guide rods 26 and 28 are joined to one another by connecting brace 30 extending between them.

The cylindrical guides over most of their length, and the connecting brace, are enclosed in a support cabinet 32. The underside of cabinet 32 is adapted to be attached to mounting pedestal 34 for installation of the anvil roller holder at a work site. To accomplish this, the edge of the underside of cabinet 32 nearest the anvil roller, has a wedged lip 36 extending downward, which dovetails with the top of pedestal 34. With additional reference to FIG. 1A also extending downward from the underside of cabinet 32, remote from lip 36 so that it will be on the opposite side of pedestal 34 from lip 36, is a screw mount 38. At the free end of screw mount 38, a pair of cylindrical pins 40 extend outward from opposite sides of screw mount 38 to hold lockpiece 42 in place by extending through elongated apertures 44 on opposite sides of lockpiece 42. Lockpiece 42 is U-shaped, with the opposing sides being on either side of the screw mount and the bottom member facing the pedestal. Screw 46 extends through the screw mount so that it comes in contact with the bottom member of lockpiece 42. Lockpiece 42 is tightened against the other slanted surface of pedestal 34, by tightening screw 46, to hold the anvil roller holder in place. Elongated apertures 44 in the opposing sides of lockpiece 42, determine the amount of play available for tightening.

Figure 1A:
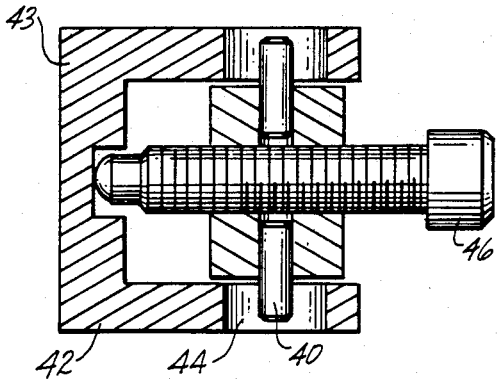
FIG. 1A at section A—A shows in greater detail the means by which the apparatus of FIG. 1 is secured to a mounting bracket.
Figures 1B, 1C, 1D:
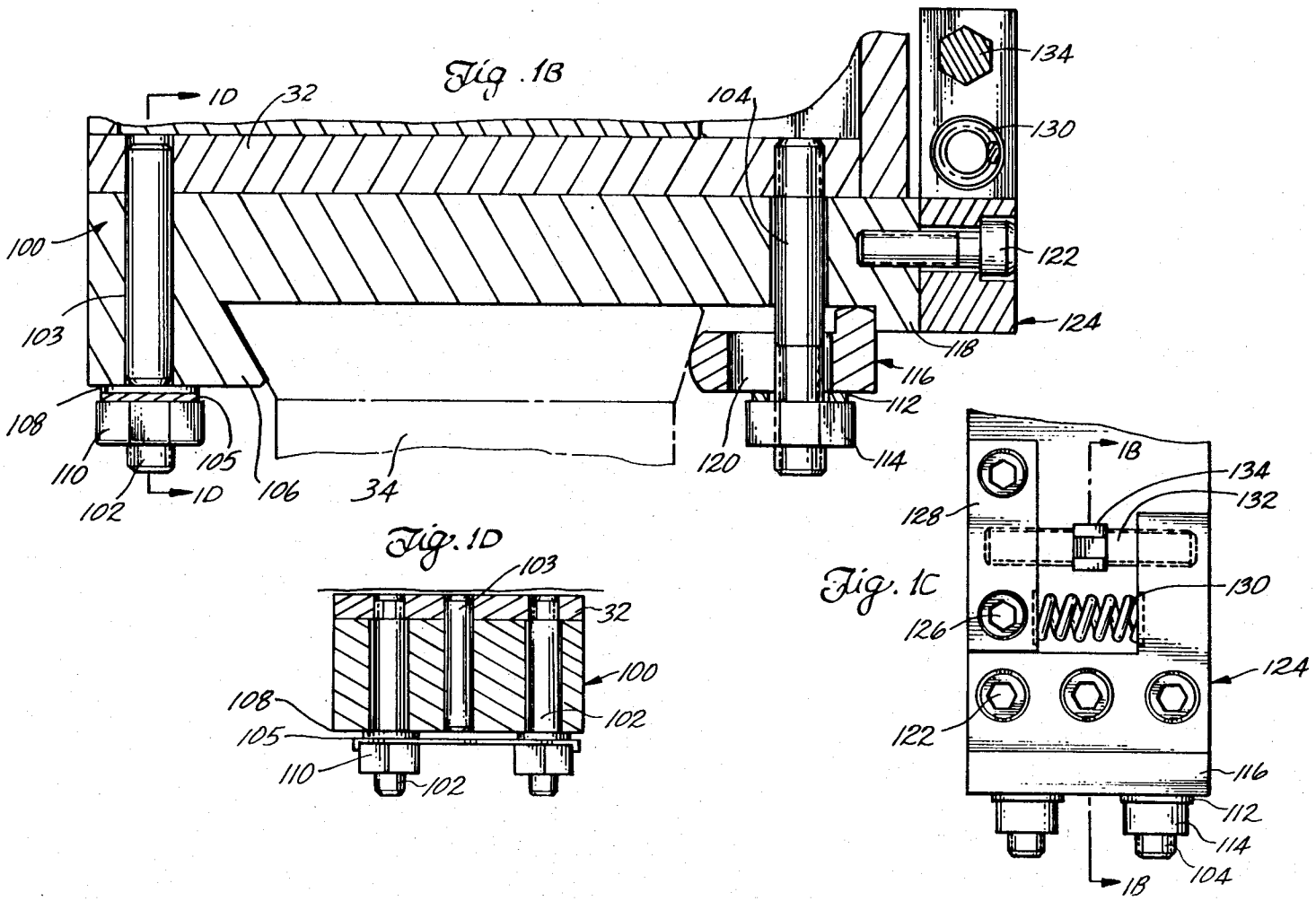
FIG. 1B shows a sectional side view of an alternate means for securing the apparatus of FIG. 1 to a mounting bracket.
FIG. 1C shows a back view of the alternate means of FIG. 1B.
FIG. 1D shows a sectional front view of the alternate means of FIG. 1B.

With reference to FIGS. 1B, 1C and 1D, there is depicted an alternate means for attaching the underside of cabinet 32 to mounting pedestal 34 for installation of the anvil roller holder at a work site. This alternate embodiment is preferred to ensure parallelism between the surface of the anvil rollers and the surface on which they will be acting, and is particularly preferred if precision parts are not used in the attachment means, to save expense.

In this embodiment, an attachment bracket 100 is positioned between the underside of cabinet 32 and the top surface of pedestal 34, by two pairs of bolts 102 and 104, and a pin 103. Pin 103 extends upward through corresponding cylindrical holes in bracket 100 and the underside of cabinet 32, located at the center of the edge nearest the anvil roller. Bracket 100 has a wedged lip 106 extending downward at this edge which dovetails with the top of pedestal 34. Pin 103 is retained in place by lock plate 105 extending across the underside of bracket 100 and covering the cylindrical hole for pin 103, which extends through bracket 100 into cabinet 32. Plate 105 is in turn held in place by bolts 102 extending up through the plate and oversized cylindrical holes in bracket 100 located on either side of pin 103 and secured to the underside of cabinet 32. Spring washers 108 are positioned on bolts 102 between the underside of bracket 100 and plate 105. Nuts 110 can be tightened down for the free end of bolts 102, to hold plate 105 in place and to hold this edge of the attachment bracket against the underside of cabinet 32.

Pin 103 provides a pivot point about which cabinet 32 can rotate with respect to attachment bracket 100. The oversized cylindrical holes in bracket 100 surrounding bolts 102, allow room for the bolts to move in the holes when cabinet 32 is pivoted. Spring washers 108 transmit the torque from the tightening of nuts 110 to the underside of bracket 100 and create the friction which must be overcome in order for cabinet 32 to pivot. This friction holds bracket 100 and cabinet 32 together and allows pivoting at the same time. The ends of plate 105 may be turned down after nuts 110 are tightened into place, to prevent the nuts for loosening.

Bolts 104 are aligned on the opposite side of pedestal 34 from bolts 102 and extend upward through oversized cylindrical holes in attachment bracket 100 and are secured to the underside of cabinet 32. Washers 112 and nuts 114 can be tightened down from the free end of bolts 104. However, mounted on bolts 104, between the underside of the attachment bracket and washers 112 and nuts 114, is an adjustable wedge 116 with an el-shaped cross-section. When tightened into place, one end of the el will rest against the other slanted surface of pedestal 34, while the other end rests against the underside of the attachment bracket. A lip 118, extending downward from the underside of the attachment bracket at the edge furthest from the anvil rollers, acts to hold adjustable wedge 116 against the pedestal.

Bolts 104 extend through adjustable wedge 116 at elongated apertures 120. These elongated apertures have a width which fits the diameter of bolts 104, but a length which allows the bolts to be positioned at various distances from the pedestal. In this way the adjustable wedge can adapt to the adjustments necessary to establish parallelism. In addition, the cylindrical holes in bracket 100 surrounding bolts 104, are oversized to allow room for bolts 104 to move when cabinet 32 is pivoted.

Attached by three bolts 122 to the side surface of the attachment bracket facing away from the anvil rollers; is adjustment bracket 124. Bracket 124 is el-shaped, with one leg of the el having bolts 122 extending through it to secure it to bracket 100, and the other leg extending upward adjacent one edge of the back surface of cabinet 32. Attachment bracket 100 is spaced from the rear surface of cabinet 32, providing a small clearance between adjustment bracket 124 and the rear surface of cabinet 32.

Attached to the back surface of cabinet 32 by a pair of bolts 126, is adjustment brace 128. Adjustment brace 128 is positioned along an edge of the rear surface of cabinet 32 above the leg of bracket 124, and is secured by bolts 122 to cabinet 32 and opposite the other leg of bracket 124. Extending between the opposed surfaces of bracket 124 and brace 128, are backlash coil spring 130 and a differential screw adjustor 132. Screw adjustor 132 is differentially threaded into each surface and centrally incorporates an integral nut 134 having a hexagonal cross-section to provide a one-piece differential screw adjustor that can be turned with a wrench.

Turning the screw adjustor one way or the other, will result it brace 128 and bracket 124 moving either closer to one another or further from one another, thereby pivoting cabinet 32 and changing the position to be assumed by the anvil roller when adjustable wedge 116 is tightened against bar 34. This allows an operator to adjust the position of the anvil roller until it is parallel to the surface to be acted upon. To this end, generally one rotation of adjustor 132 can result in a movement of brace 128 relative to bracket 124 in the order of about one-thousandth of an inch.

Guides 26 and 28 are supported in cabinet 32, only by sets of low-friction bearings 48 and 50, preferably linear ball bearings. In the presently preferred embodiment, the low-friction bearings are Thompson ball bearings, but it should be understood that any bearing providing substantially frictionless support, may be used. Bearings 48 and 50 allow in-and-out longitudinal movements of the cylindrical guides, into support cabinet 32, substantially without friction.

To provide controlled pressure to anvil roller 12, pneumatic cylinder 52 is provided within the cabinet. The central, longitudinal axis of the pneumatic cylinder is substantially parallel to guides 26 and 28, and intersects the center of bar member 16. The end of the cylinder closest anvil roller 12, is capped with cylinder head 54. Plunger 55 is loosely and frictionlessly fitted inside cylinder 52, and has a head 58, which extends across its cross-section. Rod 56 frictionlessly extends out for one surface of head 58 along the central, longitudinal axis of the cylinder through cylinder head 54, until it contacts the mounting bracket comprising bar member 16. Where the rod passes through cylinder head 54, sufficient clearance is provided to made the fit relatively loose. The loose fit of the rod and head enables the two to move within the cylinder with little, or essentially no, friction, with rods 26 and 28 being relied on to insure proper anvil roller positioning.

On the other side of plunger 55, opposite rod 56, flexible diaphragm 60 extends across the inside cross-section of the pneumatic cylinder. In the end of the cylinder, opposite cylinder head 54, is inlet 62, through which a compressed gas, or its equivalent, can be fed to the portion of the pneumatic cylinder on the side of the diaphragm opposite the plunger. When the compressed gas is fed to the cylinder, it will deflect the diaphragm, communicating the gas pressure to the point where the anvil roller contacts the material being crush-scored, through the head, rod and mounting bracket. The use of the diaphragm allows the plunger to be loosely fitted without the friction-creating gaskets that would be necessary if the plunger had to have an airtight seal with the wall of the cylinder. Gasket 64, between the outer surface of the end wall of the cylinder and the cabinet portion supporting the cylinder, prevents compressed gas from leaking around the cylinder.

Compressed gas is fed to inlet 62 through connecting conduit 66, which extends out of cabinet 32 to a source of pressure-regulated compressed gas. The pathway of conduit 66 through cabinet 32, is shown in FIGS. 1 and 2B, in combination. Pressure should be available to deliver a force to the anvil-roller, at the point of contact, sufficient to enable crush-scoring. A force up to about 50 pounds may be used. Because of gas compressibility this force remains constant because, even if there are irregularities in the diameter of anvil roller or the thickness of the web being crush-scored, the anvil roller will be able to float with the irregularities, due to the substantially frictionless support. The use of a compressed gas as a pressure source, is preferred over a relatively incompressible hydraulic fluid, so that the anvil roller is best able to float without a significant pressure change.

While it is advantageous to minimize the friction present when the anvil roller moves, it is also desirable to provide a zero point for the anvil roller, to prevent it from coming into premature or undesired contact with the wires of wire-wound crushing cylinder 68, used to support the web to be crush-scored, opposite the anvil rollers. Such contact could damage the wires of the crushing cylinder and/or the anvil rollers. A zero point is provided by screw-adjusted wedge 70. Screw-adjusted wedge 70 has a slanted or inclined surface which presses against set pin 72, extending outward from the surface of connecting brace 30. In combination with adjustment of differential screw 74, the slanted surface of wedge 70 can be moved across set pin 72, to arrive at a zero point from which anvil roller 12 extends to diaphragm 60, on application of pressure. The zero point is determined by turning differential screw 74, which in turn induces travel to the wedge, which is threaded to the screw and is driven thereby. As indicated, changing the position of the wedge, changes on its slanted surface the point at which set pin 72 will contact. Differential screw 74 extends out of cabinet 32 for easy access. A segment of guide 26 has a narrower diameter to allow room for conduit 66 and screw 74.

FIG. 2B shows the zero-point-adjustment feature as seen from above.

Figure 2:
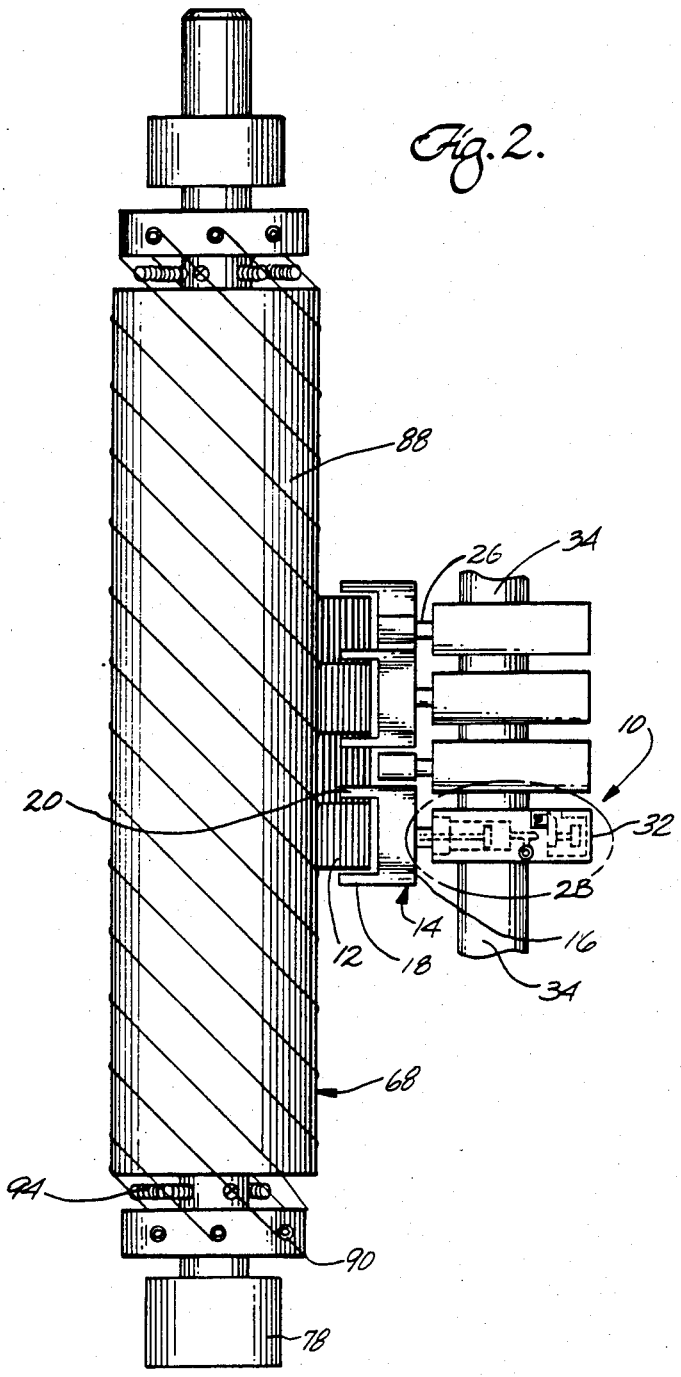
FIG. 2 shows a schematic top view of the apparatus of FIG. 1.

FIGS. 1 and 2 also show the cooperation between anvil roller holder 10 and wire-wound crushing cylinder 68 with a paper backing sheet 96 being crush-scored. The wire-wound crushing is cylinder cylindrical, and freely rotates about the axis determined by precision bearings 78. A single cylinder is normally used in conjunction with a number of anvil rollers, positioned in a staggered line by their holders, side by side and in overlapping roller arrangement.

Adjacent anvil rollers are alternately positioned above and below one another, so that the paths they roll out on the paper to be crush-scored, can overlap. It is presently preferred that the extent of this overlap be from about 0.005 to 0.01 inch. While the adjacent anvil rollers are staggered to allow overlap, they are preferably positioned relatively close to one another so that the force transmitted from rod 56 is transmitted to the material to be crush-scored, in as straight a line as possible. By staggering the anvil rollers as little as possible, so long as they do not interfere with one another, each anvil roller can be positioned as close as possible to intersecting the longitudinal axis of rod 56.

Figure 2A:
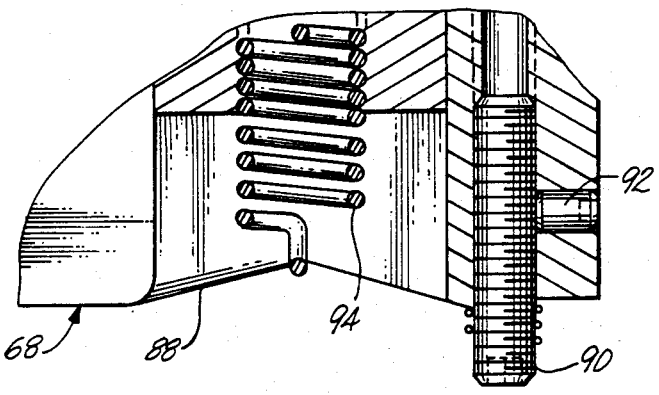
FIG. 2A shows a sectional side view of a wire end-clamp that is part of the crushing cylinder of FIG. 1.
Figure 2B:
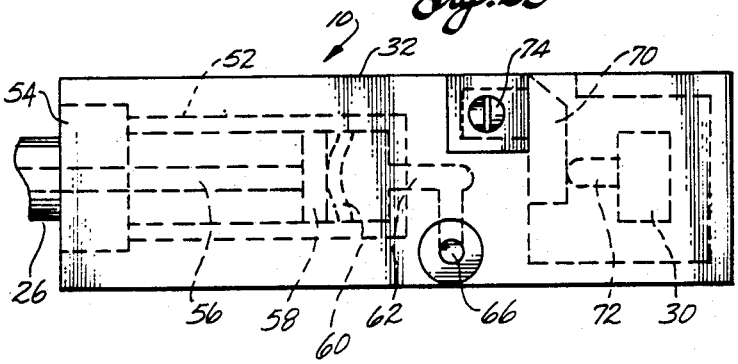
FIG. 2B shows a schematic, detailed top view of a support cabinet that is part of the apparatus of FIG. 1.

With reference to FIGS. 2 and 2A, the crushing cylinder is diagonally wound with a set of smooth cylindrical wires 88. The wires should be as perfectly round as possible, and their surfaces should be as smooth as possible. In addition, the diameter of the wires should remain constant throughout their length. The presently preferred diameter for the wires is from about 0.02 to about 0.04 inch.

Wires 88 are held taut on the crushing cylinder by screw clamps 90. Each end of a wire is held by a pair of corresponding clamps 90, attached to opposite ends of crushing cylinder 68. Each clamp is screw-adjustable, as shown in FIG. 2A, so that the wires can be held taut. A locking screw 92 meets each clamp at right angles to lock the clamp in position once a wire has been tightened. In addition, a spring 94 is provided for each clamp, with one end being connected to the end surface of the crushing cylinder adjacent the clamp on the side opposite the edge of the crushing cylinder, and the other end being looped over the end of a wire just before it is connected to the spring's corresponding clamp. Springs 94 provide a spring loading to the ends of the wires, helping to keep them taut, and compensating for expansion of the wires when the ambient temperature changes.

The wires are held in place on the surface of crushing cylinder 68 by rounded grooves extending diagonally along its surface. The grooves preferably have a depth slightly greater than the radius of wires 88. The grooves may be arranged along the surface of crushing cylinder 68 at any pattern including, but not limited to, the depicted 45-degree angle with respect to its longitudinal axis, as shown in FIG. 2. The grooves are spaced with respect to one another in any desired pattern as depicted in FIG. 1. Depicted from an axial cross-section, a protective groove is positioned every 15 degrees about the surface of the crushing cylinder.

Although the paths of adjacent anvil rollers overlap, the length of the anvil rollers are dimensioned, with respect to the distance between wires 88, so that only one anvil roller is acting against a single strand of wire, underneath the web to be crush-scored at any given time. This mode of operation is preferred so the load from one anvil roller is transferred to a single wire to maintain a constant pressure.

In this embodiment, a roller is prevented from acting on two wires at once. In consequence, an irregularity in one of the wires, such as increased diameter, will not result in reduced pressure on the adjacent wire and a score mark that is too shallow.

Figure 5:
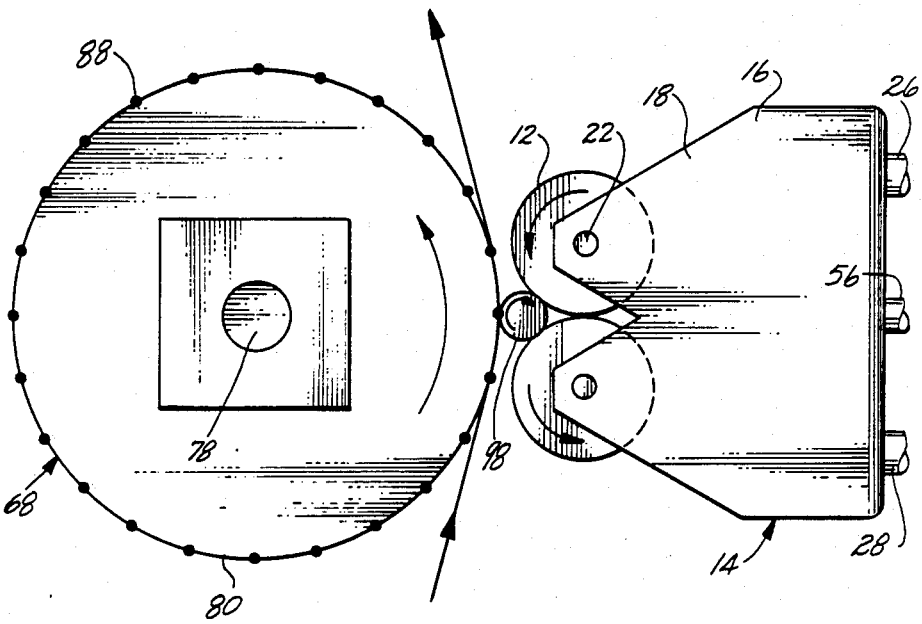
FIG. 5 shows a schematic side view of an alternate embodiment of an apparatus for applying constant pressure in crush-scoring in accordance with the instant invention.

Nonetheless, FIG. 5 shows an alternate functional embodiment of the present invention. In this embodiment, a single small dowel 98 acts at one time, against the full length of the crushing cylinder and all the wires. Dowel 98 is held in place by a number of adjacent anvil roller holders. Mounting bracket 14 is arranged to hold two anvil rollers 12 one on top of the other. Anvil rollers 12 combine to hold dowel 98 in place against the crushing cylinder. As indicated, this embodiment is not as preferred as that wherein an anvil roller acts on a single strand of wire at a time, but it is preferred over having one long anvil roller act on all the wires, because the dowel has some give to it so that it can react to irregularities in individual wires, and the dual anvil rollers provide individual sources of force that can react individually to such irregularities. Dowel 98 should be flexible enough to transfer the load from anvil rollers to all wires on the roll.

Figure 3:
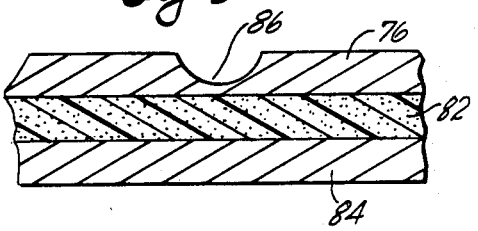
FIG. 3 shows an idealized side view of a product with a crush-scored backing sheet.
Figure 4:
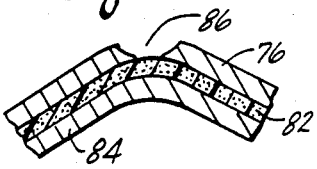
FIG. 4 shows a sectional, magnified side view of the product of FIG. 3, flexed to cause cracking at the crush-score.

With reference to FIG. 3, paper stock for release liner 76, has been secured to adhesive layer 82, which in turn is secured to surface sheet 84. A score mark 86 is shown in side view. If the thickness of backing sheet 76 is from about 0.003 to about 0.008 inch, this amount of compaction allows the backing sheet to split or tear when flexed, as shown in FIG. 4, but is sufficiently sturdy to withstand peel-across at score lines.

The principal objective in the use of the apparatus of the instant invention, is to keep it operative under essentially frictionless conditions with only a unilateral force being applied through the fluid pressure against the diaphragm, such that the anvil rollers will float with fluctuations in paper thickness. The use of gaseous pressure is preferred, as compressibility of the gas allows for movement of the anvil rollers to and from cabinet 32 without any significant changes in applied pressure. However, to minimize any fluctuations, the diameters of the anvil roller, the crushing cylinder, and the wire, are controller to as close a tolerance as possible. While cylindrical guide rods are currently used, they may be of any cross-sectional configuration, so long as there are available for them, bearings to enable essentially frictionless movement in and out of cabinet 32.

Similarly, since rod 56 may also be of any cross-sectional configuration, as it is essentially mounted in cooperation with head 58 and diaphragm 60 in a frictionless manner. With reference to FIGS. 1 and 2, the web of material (paper) to be scored 96 is passed between anvil roller 12 and the wire 88 of crushing cylinder 68. Any number of anvil roller assemblies may be mounted on support 34 in a parallel array. The amount of pressure applied to diaphragm 60 of each assembly, determines the compressive force to be applied to crush-score paper 96. With the aid of backlighting, an operator can view from above, the direction of paper travel, and can ascertain if the depth of the diagonal score is uniform, If not, the operator, by adjusting the pressure associated with any given anvil roller, can insure that the diagonal crush-score will be uniform throughout the width of the web. This insures, when the paper is coated with a release material such as a silicone release coating after scoring and then laminated to an adhesive and a facestock, that there will be at all times, uniform performance in the crack-and-peel operation of the construction.

To this end, it is desired that the paper be scored before applying a low-energy release surface on the opposed side thereof, for, if earlier applied, the pressure applied during the scoring operation could crack the release coating and provide a product of inferior quality.

The preceding description has been presented with reference to a presently preferred embodiment of the invention shown in the accompanying drawings. Workers skilled in the art and technology to which this invention pertains, will appreciate that alterations and changes in the described apparatus and structure can be practiced without meaningfully departing from the principles, spirit and scope of this invention. Accordingly, the foregoing description should not be read as pertaining only to the precise structures and techniques described, but rather should be read consistent with, and as support for, the following claims which are to have their fullest fair scope.

What is claimed is:

1. A method for crush-scoring a web of paper comprising the steps of:

(a) passing one side of a web of paper to be crush-scored in contact with the outer side surface of a crush-scoring cylinder having diagonal crush-scoring protrusions extending from the surface thereof and rotating in the direction of the paper travel;

(b) contacting the side of the web of paper opposite the side of the web of paper which is in contact with the crush-scoring cylinder with a plurality of cylindrical anvil roller rotating in the direction of paper travel, each cylindrical anvil roller being mounted to enable essentially frictionless movement to or from the point of contact with the web of paper and positioned to essentially contact no more than one protrusion at any time; and (c) unidirectionally applying a preselected force to each cylindrical anvil roller against the web of paper, to form in cooperation with the protrusions diagonal crushscores of substantially constant depth.

2. A method for diagonally crush-scoring a web of paper comprising the steps of:

(a) passing one side of the web of paper to be diagonally crush-scored over a crush-scoring cylinder having an axis and a plurality of wires extending diagonally across the crush-scoring cylinder from end to end in spaced relation to each other, said crush-scoring cylinder rotating in the direction of paper travel;

(b) contacting the opposed side of the web of paper to be diagonally crush-scored with a plurality of cylindrical anvil rollers positioned side by side in overlapping relation, whereby each cylindrical anvil roller contacts no more than one wire of the crush-scoring cylinder at any time, said cylindrical anvil roller rotating in the direction of paper travel and being supported in relation to the crush-scoring cylinder to enable individual movement of each cylindrical anvil roller to or from the point of contact with the web of paper in a substantially frictionless manner and (c) independently applying to each cylindrical anvil roller, pneumatic pressure at a level sufficient to crush-score the web of paper to a predetermined depth, the pneumatic pressure being unidirectionally transmitted to each cylindrical anvil roller in the direction of said crush-scoring cylinder by a pressurized diaphragm acting on a plunger urged against a mounting bracket supporting said cylindrical anvil roller in free rotational movement.

3. In a method for crush-scoring a web of paper comprising the steps of passing one side of a web of paper to be crushed-scored in contact with the outer surface of a crush-scoring cylinder having one or more diagonal crushscoring protrusions extending from the surface thereof and rotating in the direction of the paper travel and means for applying a crush-scoring force to the opposed side of the web of paper to crush score the paper, the improvement which comprises contacting the side of the web of paper opposite the side in contact with the crush-scoring cylinder with a plurality of cylindrical anvil rollers disposed across the width of the crush-scoring cylinder for contact with the web of paper opposite the side of the web of paper in contact with the crush-scoring cylinder, each anvil roller essentially contacting more than one protrusion of the crush-scoring cylinder at any time and rotating in the direction of paper travel, each anvil roller independently applying a preselected force against the web of paper passing over a protrusion and forming by the applied force of each of the plurality of anvil rollers in contact with the web of paper a diagonal crush-score of substantially constant depth across the width of the web of paper.

4. A method for crush-scoring a web of paper comprising the steps of:

(a) passing one side of a web of paper to be crush-scored in contact with the outer surface of a crush-scoring cylinder having spaced diagonal crush-scoring protrusions extending from the surface thereof and rotating in the direction of the paper travel;

(b) contacting the side of the web of paper opposite the side in contact with the crush-scoring cylinder with a plurality of serial cylindrical anvil rollers each rotating by contact with the web of paper in the direction of paper travel, each cylindrical anvil roller being mounted to enable independent movement to or from the point of contact with the web of paper and dimensioned such that each anvil roller is essentially in contact with no more than one crush-scoring protrusion at any time; and (c) applying a preselected force to each cylindrical anvil roller and forming by the applied force of each of the plurality anvil rollers diagonal, crush-scores of substantially constant depth across the width of the web of paper.

5. A method for crush-scoring a web of paper comprising the steps of:

(a) passing one side of web of paper to be crush-scored in contact with the outer side surface of a crush-scoring cylinder having diagonal crush-scoring wire protrusions extending from the surface thereof said crush-scoring cylinder rotating in the direction of the paper travel;

(b) contacting the side of the web of paper opposite the side in contact with the crush-scoring cylinder with a plurality of serial cylindrical anvil rollers, each anvil roller partially extending across the crush-scoring cylinder and rotating by contact with the web of paper in the direction of paper travel and mounted to enable independent movement to or from the point of contact with the web of paper and dimensioned such that each anvil roller is essentially in contact with no more than one crush-scoring protrusion at any time; and (c) applying a preselected force to each cylindrical anvil roller and forming by the applied force of each of the plurality anvil rollers diagonal, continuous crush-scores of substantially constant depth across the width of the web of the paper.

6. A method for crush-scoring a web of paper comprising the steps of:

(a) passing one side of a web of paper to be crush-scored in contact with the outer side surface of a crush-scoring cylinder having diagonal crush-scoring protrusions extending from from the surface thereof and rotating in the direction of the paper travel;

(b) contacting the side of the web of paper opposite the side of the web of paper which is in contact with the crush-scoring cylinder with a plurality of cylindrical anvil rollers rotating in the direction of paper travel, each cylindrical anvil roller being mounted to enable essentially frictionless movement to or from the point of contact with the web of paper and positioned to provide individual sources of force that are able to react to irregularities in individual protrusions and substantially contact no more than one protrusion at any time; and (c) unidirectional applying a preselected force to each cylindrical anvil roller against the web of paper, to form in cooperation with the protrusions, diagonal crush-scores of substantially constant depth.

* * * * *

UNITED STATES PATENT AND TRADEMARK OFFICE

CERTIFICATE OF CORRECTION

PATENT NO. : 4,881,935

DATED : November 21, 1989

INVENTOR(S) : Yefim Slobodkin

It is certified that error appears in the above-identified patent and that said Letters Patent is hereby corrected as shown below:

Column 1, line 30, change "purpose" to -- purposes --.
Column 1, lines 37 and 38, change "Crushscoring" to -- Crush-scoring --.
Column 1, line 59, change "lables" to -- labels --.

Column 3, line 32, change "supportedd" to -- supported --.

Column 5, line 40, after "result" change "it" to -- in --.
Column 5, line 67, after "out" change "for" to -- from --.

Column 6, line 4, after "provided to" change "made" to -- make --.

Column 7, line 6, change "is cylinder" to -- cylinder is --.
Column 7, lines 60,61, change "protective" to -- prospective --.

Column 8, line 45, change "controller" to -- controlled --.

UNITED STATES PATENT AND TRADEMARK OFFICE

CERTIFICATE OF CORRECTION

PATENT NO. : 4,881,935

DATED : November 21, 1989

INVENTOR(S) : Yefim Slobodkin

It is certified that error appears in the above-identified patent and that said Letters Patent is hereby corrected as shown below:

In the Claims

Column 9, line 34, change "roller" to -- rollers --.
Column 9, line 43, change "crushscores" to
-- crush-scores --.

Column 10, line 11, change "crushscoring" to
-- crush-scoring --.

Column 11, line 15, delete "from" (second occurrence).

Signed and Sealed this

Sixth Day of August, 1991

*Attest:*

HARRY F. MANBECK, JR.

*Attesting Officer*

*Commissioner of Patents and Trademarks*